US010213068B2

(12) United States Patent
Diamond

(10) Patent No.: US 10,213,068 B2
(45) Date of Patent: Feb. 26, 2019

(54) POWER CONSUMPTION MANAGEMENT METHODS AND SYSTEMS FOR PRODUCT DISPENSERS

(71) Applicant: GPCP IP Holdings LLC, Atlanta, GA (US)

(72) Inventor: Russell Diamond, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 121 days.

(21) Appl. No.: 15/298,858

(22) Filed: Oct. 20, 2016

(65) Prior Publication Data

US 2017/0112335 A1 Apr. 27, 2017

Related U.S. Application Data

(60) Provisional application No. 62/245,447, filed on Oct. 23, 2015.

(51) Int. Cl.
*A47K 10/34* (2006.01)
*A47K 10/32* (2006.01)

(52) U.S. Cl.
CPC ..... *A47K 10/34* (2013.01); *A47K 2010/3226* (2013.01)

(58) Field of Classification Search
CPC ..... A47K 10/34; A47K 10/36; A47K 2010/3226; A47K 2010/3253
See application file for complete search history.

(56) References Cited

U.S. PATENT DOCUMENTS

| | | | | |
|---|---|---|---|---|
| 5,691,919 | A | 11/1997 | Gemmell et al. | |
| 5,918,197 | A | 6/1999 | Toussant et al. | |
| 6,065,639 | A | 5/2000 | Maddox et al. | |
| 6,360,181 | B1 * | 3/2002 | Gemmell | A47K 5/1202 705/22 |
| 6,411,920 | B1 | 6/2002 | McConnell et al. | |
| 6,895,296 | B2 | 5/2005 | Holt et al. | |
| 7,554,084 | B2 | 6/2009 | Mok et al. | |
| 7,590,467 | B2 | 9/2009 | Holt et al. | |
| 7,996,108 | B2 | 8/2011 | Yardley | |
| 8,346,302 | B2 | 1/2013 | Alameh et al. | |
| 8,408,487 | B2 | 4/2013 | Rodrian et al. | |
| 8,453,877 | B2 | 6/2013 | Ionidis | |

(Continued)

FOREIGN PATENT DOCUMENTS

| | | |
|---|---|---|
| GB | 2489965 | 10/2012 |
| WO | 2012178045 | 12/2012 |
| WO | 2013113129 | 8/2013 |

*Primary Examiner* — Timothy R Waggoner
(74) *Attorney, Agent, or Firm* — Eversheds Sutherland (US) LLP

(57) ABSTRACT

Certain dual roll dispensers and methods of dispensing sheet product are provided. In one example, the method includes receiving, by the controller, a first trigger from at least one motion sensor. The method includes determining an active product being dispensed by the dispenser, and powering, in response to the first trigger, a measurement device configured to measure an amount of the active product dispensed by the dispenser. The method also includes receiving, from the measurement device, dispense event information associated with the measured amount of the active product dispensed by the dispenser during a dispense event, and storing the dispense event information.

26 Claims, 4 Drawing Sheets

(56) References Cited

U.S. PATENT DOCUMENTS

| | | | | |
|---|---|---|---|---|
| 2003/0078691 | A1* | 4/2003 | Holt | A47K 10/38 700/139 |
| 2005/0167541 | A1* | 8/2005 | Osborne | A47K 10/36 242/563 |
| 2007/0176041 | A1* | 8/2007 | Friesen | B65H 16/06 242/563 |
| 2008/0116356 | A1* | 5/2008 | Mok | A47K 10/36 250/208.1 |
| 2008/0245922 | A1* | 10/2008 | Fellhoelter | A47K 10/36 242/554.6 |
| 2009/0119142 | A1* | 5/2009 | Yenni | G06Q 10/06 705/7.15 |
| 2009/0254357 | A1 | 10/2009 | Gisske | |
| 2013/0096729 | A1 | 4/2013 | Wegelin | |
| 2014/0001303 | A1 | 1/2014 | Tramontina et al. | |
| 2015/0327735 | A1* | 11/2015 | Himmelmann | A47K 10/3836 221/34 |
| 2016/0227970 | A1* | 8/2016 | Diamond | B65H 43/00 |
| 2016/0262580 | A1* | 9/2016 | Fellhoelter | A47K 10/3687 |

* cited by examiner

POWER CONSUMPTION MANAGEMENT METHODS AND SYSTEMS FOR PRODUCT DISPENSERS

CROSS-REFERENCE TO RELATED APPLICATIONS

This application claims the benefit of U.S. Provisional Application No. 62/245,447, filed Oct. 23, 2015, which is hereby incorporated by reference in its entirety.

FIELD OF THE DISCLOSURE

The present disclosure generally relates to power consumption management methods and systems, and more particularly to systems and methods of power consumption management for product dispensers, including but not limited to tissue or other sheet product dispensers.

BACKGROUND

Dispensers may be used to dispense various consumer products, such as paper towels, tissues, disposable wipes, and other sheet or paper products. Some dispensers may be equipped with electrical systems with hardware configured to collect data on and/or record usage of the dispensed product in order to quantify product usage. Such data may include an amount of product dispensed by users, for example. The hardware used to collect the data requires electrical power to operate. However, electrical power may not be readily available at the location of the dispenser, therefore requiring batteries or other depletable energy sources to power the data collection hardware. Because the batteries or energy sources may have limited capacity and/or lifespans, frequent replacement or observation may be required to maintain hardware functionality, resulting in increased maintenance costs associated with the dispenser. Accordingly, there is a need to manage power consumption of electrical systems at dispensers.

SUMMARY

Certain embodiments of the disclosure provide systems and methods of managing power consumption at dispensers. In particular, the present disclosure relates to systems and methods for managing power consumption of data collection systems at dispensers. According to one or more embodiments of the disclosure, a method of managing power consumption at a dispenser is provided. The method includes receiving, by the controller, a first trigger from at least one motion sensor. The method includes determining an active product being dispensed by the dispenser, and powering, in response to the first trigger, a measurement device configured to measure an amount of the active product dispensed by the dispenser. The method also includes receiving, from the measurement device, dispense event information associated with the measured amount of the active product dispensed by the dispenser during a dispense event, and storing the dispense event information.

According to one or more embodiments of the disclosure, a dispenser is provided. The dispenser includes at least one motion sensor and an energy source. The dispenser also includes one or more measurement devices, and a controller communicatively coupled to the at least one motion sensor the energy source, and the one or more measurement devices. The controller includes a memory having computer-executable instructions operable to, when executed by at least one processor, enable the at least one processor to implement a method that includes receiving a first trigger from the at least one motion sensor, determining an active product being dispensed by the dispenser, and powering, in response to the first trigger, one of the one or more measurement devices configured to measure an amount of the active product dispensed by the dispenser. The method also includes receiving, from the powered measurement device, dispense event information associated with the measured amount of the active product dispensed by the dispenser during a dispense event, and storing the dispense event information in the memory.

Other systems and methods according to various embodiments of the disclosure will be apparent or will become apparent to one with skill in the art upon examination of the following figures and the detailed description. All other features and aspects, as well as other systems and methods are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

Figure 1:
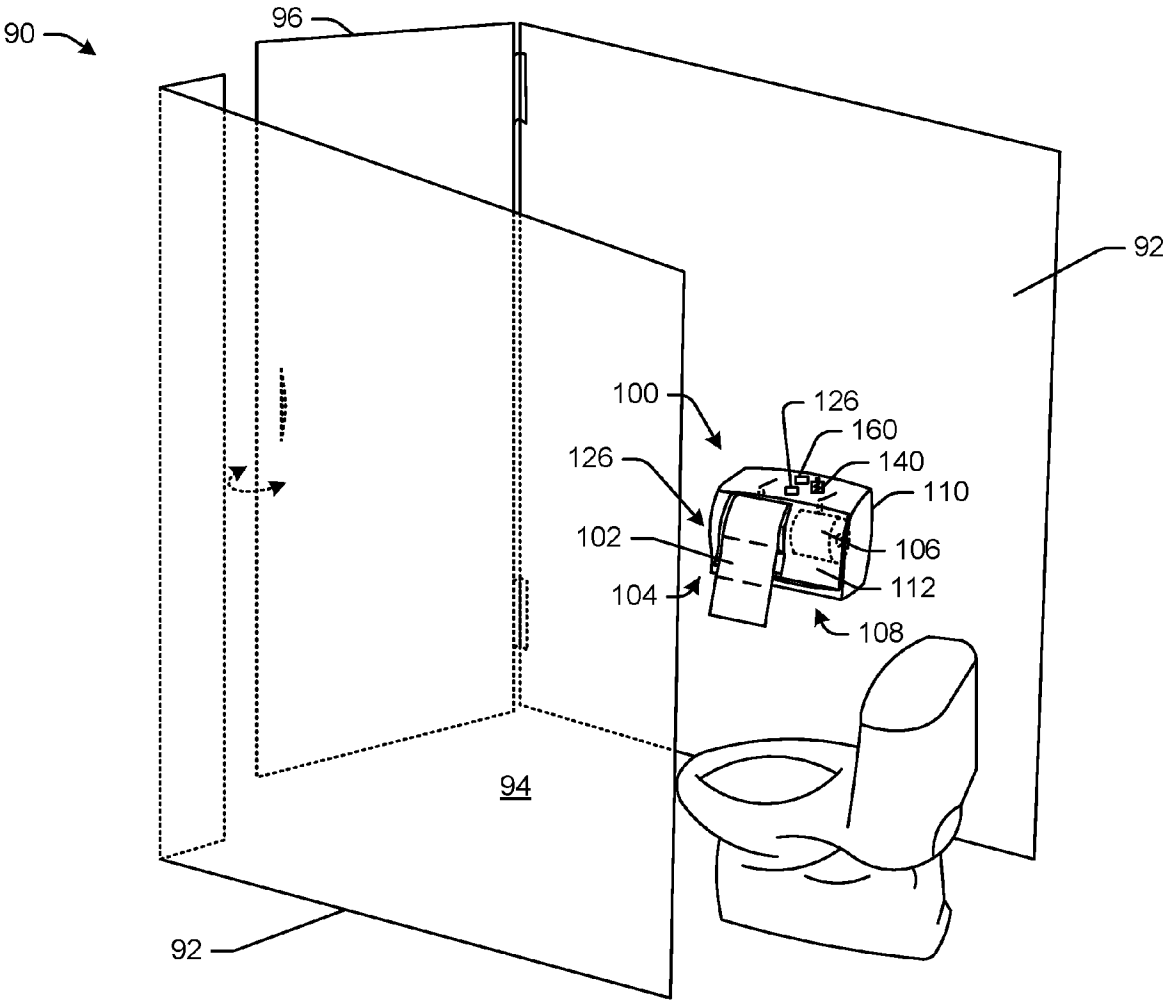
FIG. 1 illustrates a dual roll dispenser in an exemplary restroom environment in accordance with one or more example embodiments of the present disclosure.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art.

DETAILED DESCRIPTION

The present disclosure is directed to dispensers with electrical systems, such as data collection systems, and methods for managing power consumption at the dispensers described herein. Broadly, the systems and methods described herein may extend the lifespan of, or reduce the need for, batteries or other depletable energy sources used to power electrical systems, such as data collection systems, at dispensers by managing power consumption of the data collection systems. The dispensers described herein are configured to monitor usage of product dispensed from the dispenser. In some embodiments, the dispensers described herein dispense multiple products, and may monitor or collect usage data of each dispensable product, while in other embodiments the dispenser dispenses a single product and monitors or collects usage data of the single product. For example, the dispensers described herein may include dual tissue paper rolls, where each tissue paper roll is housed in an adjacent portion of the dispenser. The dispensers may include a data collection system positioned within the dispenser. The data collection systems described herein may be configured to collect and/or record data associated with dispense events of an active product. For example, the data collection systems may be configured to collect and record dispense event information such as a length of dispensing time, a sheet length or other amount of product dispensed, an active product identifier, a dispensing direction for sheet product rolls, and/or a speed of dispensing. A dispense event may occur when a user removes product from the dispenser, and may be based at least in part on time, as well as other factors discussed herein. In embodiments where the dispenser includes multiple products, the active product is the product being dispensed, while the remaining undispensed products are inactive.

The data collection system may collect data using measurement devices that require electrical power from an energy source, such as a battery. The measurement devices may draw a disproportionate amount of power from, or may otherwise cause a large drain on, the energy source, thereby leading to frequent replacement of the energy source. However, the measurement devices only need to draw power and be operational when a dispense event is imminent. In order to determine when a dispense event is imminent, embodiments of the disclosure include one or more motion sensors configured to trigger the data collection system of the dispenser upon activation of the one or more motion sensors, thereby awaking the data collection system, including the measurement devices, from a low-power state. Accordingly, the dispensers of the present disclosure may reduce or eliminate the need for depletable energy sources, such as batteries, that power data collection systems at dispensers by activating the data collection system prior to a dispense event. Certain systems and methods of the present disclosure may therefore require less frequent observation by maintenance personnel and/or reduced maintenance associated with the dispensers.

One or more technical solutions can be achieved by certain embodiments of the disclosure. For example, in at least one embodiment, the data collection system of a dispenser may remain in a sleep or low-power state, thereby reducing power consumption of the data collection system, until the data collection system is activated by a motion sensor. Costs associated with replacement of energy sources and associated maintenance may be reduced as a result from certain systems and methods described in the disclosure.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

With reference now to FIG. 1, an exemplary dual roll dispenser 100 according to one or more embodiments of the present disclosure is illustrated in a restroom environment 90. The dual roll dispenser 100 may be mounted on either sidewall 92 of a restroom stall 94, such that the dual roll dispenser 100 is accessible to a user in the stall 94. The illustrated dual roll dispenser 100 is configured to dispense paper product, and more specifically, tissue paper, from each of the dual tissue rolls. The dual roll dispenser 100 is configured to dispense tissue from a first tissue roll 102 positioned in a first dispenser portion 104 of the dual roll dispenser 100, and from a second tissue roll 106 positioned in a second dispenser portion 108 of the dual roll dispenser 100. The dual roll dispenser 100 includes a housing 110 with a sliding door 112 configured to slide with respect to the housing 110 and to cover either the first dispenser portion 104 or the second dispenser portion 108, such that only one tissue roll can be dispensed at a time. The housing 110 may be of any suitable size or shape to accommodate the tissue rolls 102, 106. Other embodiments may not include a door, such that tissue may be dispensed from either tissue roll 102, 106 at the same time. Some embodiments may include other mechanisms, rather than a sliding door, to prevent access to certain product or portion thereof. Examples include swinging doors, cabinets, flaps, or other mechanisms. Additionally, although a dual roll dispenser is illustrated as an exemplary embodiment, other dispensers such as jumbo tissue dispensers, single roll dispensers, napkin dispensers, tabletop dispensers, sheet product dispensers, and other paper product dispensers are contemplated in the present disclosure and can incorporate the power consumption management methods and systems described herein.

The first and second tissue rolls 102, 106 may be loaded into the dual roll dispenser 100. In some embodiments, the first and second tissue rolls 102, 106 may be positioned within the housing 110 of the dual roll dispenser 100, while in other embodiments the first and second tissue rolls 102, 106 may be positioned partially outside of the dual roll dispenser 100. In the illustrated embodiment, the first and second tissue rolls 102, 106 are positioned within the housing 110 and are loaded such that the first and second tissue rolls 102, 106 may rotate with respect to the housing 110 in order to dispense tissue paper.

The first and second tissue rolls 102, 106 may have different tissue paper or paper properties. The first and second tissue rolls 102, 106 may include a product identifier that allows the dual roll dispenser 100 to identify the first and second tissue rolls 102, 106. Product identifiers include, but are not limited to, printed indicators, such as barcodes, Quick Response codes, and the like, and/or reference indicators, such as fluorescent ink indicators, magnetic ink indicators, phosphorescent ink indicators, and the like. The product identifiers may be positioned on an external surface of the first and second tissue rolls 102, 106, for example on a side surface of the tissue paper or a side surface of a core of the tissue paper, or an internal surface, for example on an internal surface of the core of the tissue roll. The product identifier may be associated with properties of the tissue paper of each the first and second tissue rolls 102, 106. For example, as discussed above, the product dispensed by the dual roll dispenser 100 may be any paper product, including napkins, tissues, paper towels, wipes, and the like. The product may have variable absorbable properties and may be either dry or moist product. The product may also have varying physical dimensions, including width and thickness, and in some embodiments the product may be perforated. The product identifiers may be associated with the respective paper properties of the tissue of each of the first and second tissue rolls 102, 106. The product identifiers may be read by hardware, such as an active product sensor as described below, included in the dual roll dispenser 100.

Figure 2:
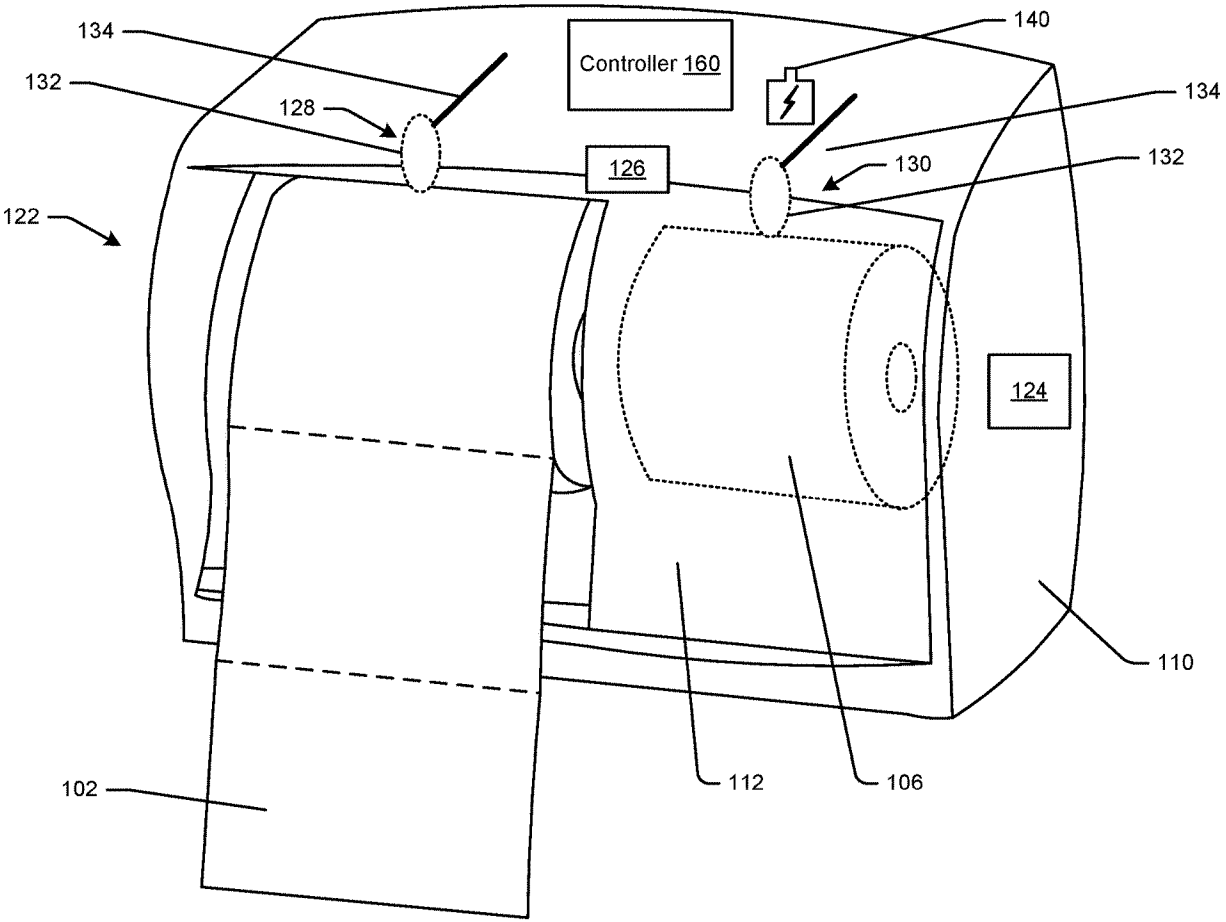
FIG. 2 illustrates a perspective view of the dual roll dispenser of FIG. 1 in accordance with one or more example embodiments.

Referring now to FIG. 2, the dual roll dispenser 100 is schematically illustrated in perspective view. The dual roll dispenser 100 includes a data collection system 120, an energy source 140, and a controller 160 configured to operate the data collection system 120 and manage the energy source 140. Other embodiments of the dual roll dispenser 100 may include additional or fewer components, although one exemplary embodiment is depicted in FIG. 2. For example, in some embodiments, the controller 160 may be integrated into either the data collection system 120 or the energy source 140, rather than being a discrete component.

The dual roll dispenser 100 includes the data collection system 120 with at least one motion sensor, an active product sensor 126, a first measurement device 128, and a second measurement device 130. In the illustrated embodiment, the dual roll dispenser 100 includes two motion sensors, specifically a first motion sensor 122 and a second motion sensor 124. The first and second motion sensors 122, 124 may be electronic sensors, such as passive infrared sensors, in some embodiments. In other embodiments, the first and second sensors 122, 124 may be any sensor configured to detect movement, such as heat sensors, microwave sensors, and other sensors, although the type of sensor used to detect motion may affect the coverage area of the respective sensor and the power draw required to operate the first and second motion sensors 122, 124. Additional examples of motion sensors include proximity sensors, photovoltaic sensors, ambient light sensors, and the like. Some embodiments of the dual roll dispenser 100 may include a single motion sensor, while other embodiments may include two or more motion sensors.

The first and second motion sensors 122, 124 are configured to detect motion within a coverage area of the first and second motion sensors 122, 124, thereby indicating movement or presence of a user upon activation. For example, the first or second motion sensor 122, 124 may detect motion of a stall door 96 (shown in FIG. 1), which may be associated with a user entering or leaving the stall 94. Activation of the motion sensors may be based at least in part on the type of motion sensor employed. For example, if either of the first or second motion sensors 122, 124 are passive infrared sensors, the first and second motion sensors 122, 124 may detect a change in infrared radiation surrounding the sensor and activate if a gradient of the change in infrared radiation exceeds a predetermined value. Upon activation, the activated motion sensor may send a first trigger or signal to the controller 160, as described herein. The first trigger may awake the controller 160 from a sleep mode or low-power state, and may indicate that a user is present and that a dispense event may occur.

Referring back to FIG. 1, the first and second motion sensors 122, 124 may be positioned about the dual roll dispenser 100 such that the dual roll dispenser 100 can be reversibly positioned on either sidewall 92 of the stall 94, such that the stall door 96 is still within the coverage area of either the first motion sensor 122 or the second motion sensor 124. In this manner, a user entering or exiting the restroom stall 94 will activate one of the first or second motion sensors 122, 124. In the embodiment illustrated in FIG. 1, the first motion sensor 122 is positioned at one end 125 of the dual roll dispenser 100 and the second motion sensor 124 is positioned at the opposite end 127 of the dual roll dispenser 100. Therefore, the dual roll dispenser 100 may be positioned on either sidewall 92 of the stall 94, and the stall door 96 will still be within the coverage area of one of the first or second motion sensors 122, 124. In other embodiments, the first and second motion sensors 122, 124 may be positioned in different locations about the dual roll dispenser 100, based at least in part on the coverage area of the respective sensor. In embodiments with a single motion sensor, the single motion sensor may be movable with respect to the dual roll dispenser 100, such that the dual roll dispenser 100 may be reversibly positioned in a restroom stall, for example.

Referring again to FIG. 2, the data collection system 120 includes the active product sensor 126. In the illustrated embodiment, the active product sensor 126 is configured to facilitate a determination of which product, from either the first tissue roll 102 or the second tissue roll 106, is actively being dispensed from the dual roll dispenser 100. The active product sensor 126 may facilitate this determination by determining a position of the sliding door 112, for example. The active product sensor 126 may be a door position sensor configured to determine which position the sliding door 112 is in, and which tissue roll 102, 106 is being covered by the sliding door 112. The tissue roll 102 that is not covered by the sliding door 112 is determined to be the active product, and is accessible to users for dispensing. The tissue roll 106 that is covered by the sliding door 112 is determined to be the inactive product, and is not accessible to users for dispensing. In the illustrated embodiment, the first tissue roll 102 is the active product and the second tissue roll 106 is the inactive product, as determined by the accessibility to the respective tissue rolls for dispensing.

The data collection system 120 includes the first and second measurement devices 128, 130. The data collection system 120 may include one measurement device for each product dispensed by the dual roll dispenser 100, as shown. Other embodiments may include additional or fewer measurement devices with respect to products dispensed. The first and second measurement devices 128, 130 may be any device configured to measure dispensing event information of an active product during a dispense event. A dispense event occurs when product is removed from the dispenser by a user. Dispense event information may include a length of product dispensed, a length of dispensing time, an active product identifier, a dispensing direction of the active product, a speed of dispensing, or a combination thereof. In an embodiment, the dispense event information is the total length of tissue or other sheet product dispensed during a single usage event, e.g., a single visit to the restroom by a user.

In the illustrated example, the first measurement device 128 may be a first rotary encoder 132, and the second measurement device 130 may be a second rotary encoder 134. The first and second rotary encoders 132, 134 may each include a respective rotary portion 136 and a respective shaft portion 138 and may be configured to convert angular positioning or motion of the respective rotary portion 136 into digital or analog code to send to the controller 160. The rotary portion 136 of each respective rotary encoder 132, 134 may contact an outer surface of the first or second tissue rolls 102, 106, respectively and may rotate with respect to the respective tissue roll 102, 106 as tissue is dispensed. Specifically, rotation of the respective tissue roll 102, 106 during a dispense event may impart reciprocal rotational motion to the rotary portion 136 of the respective rotary encoder 132, 134. As described below, only the measurement device associated with the active product is powered and collects data when the data collection system 120 is activated.

The dual roll dispenser 100 includes the energy source 140. In the illustrated embodiment, the energy source 140 is electrically coupled to the controller 160, the active product sensor 126, the first measurement device 128, and the second measurement device 130. In embodiments where the first and second motion sensors 122, 124 are passive infrared sensors, the first and second motion sensors 122, 124 may not need to be electrically coupled to the energy source 140, as the passive infrared sensors are operable without added energy. The energy source 140 is configured to provide energy to connected components. For example, the energy source 140 may power the controller 160 and the first and second measurement devices 128, 130. The energy source 140 may be any suitable device configured to store and/or provide energy, for example a rechargeable battery, including, but not limited to, nickel metal hydride, wet cells, dry cells, lead-acid, lithium, lithium hydride, lithium ion, or the like, at any suitable voltage and/or output current. Other examples of energy sources 140 include capacitors such as super capacitors and electric double layer capacitors, electromechanical or electromagnetic energy sources, and chemical energy sources.

Operation of the dual roll dispenser 100 is controlled by the controller 160 in the illustrated embodiment. The controller 160 is electrically and/or communicatively coupled to the first and second motion sensors 122, 124, the active product sensor 126, the energy source 140, and the first and second measurement devices 128, 130. The controller 160 may include one or more processors 162 and/or memory components 164. The controller 160 may be implemented as appropriate in hardware, software, firmware, or combinations thereof. Software or firmware implementations of the controller 160 may include computer-executable or machine-executable instructions written in any suitable programming language to perform the various functions described. Hardware implementations of the controller 160 may be configured to execute computer-executable or machine-executable instructions to perform the various functions described. The controller 160 may include, without limitation, a central processing unit (CPU), a digital signal processor (DSP), a reduced instruction set computer (RISC), a complex instruction set computer (CISC), a microprocessor, a microcontroller, a field programmable gate array (FPGA), or any combination thereof. In other embodiments, operation of the dual roll dispenser 100 may be controlled by other hardware or software arrangements, including hardware logic.

Figure 3:
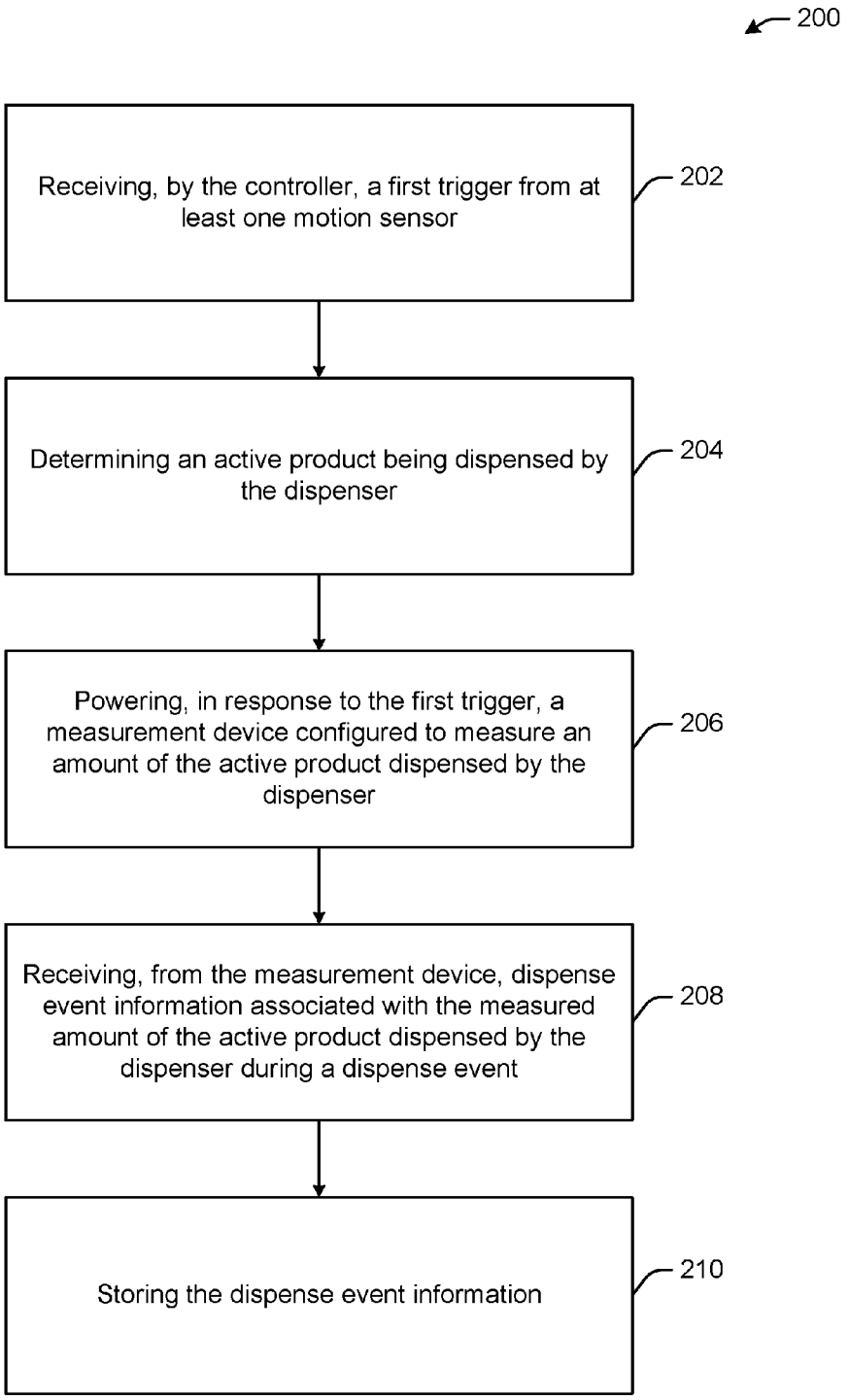
FIG. 3 illustrates an exemplary method of managing power consumption at a dispenser in accordance with one or more example embodiments.
Figure 4:
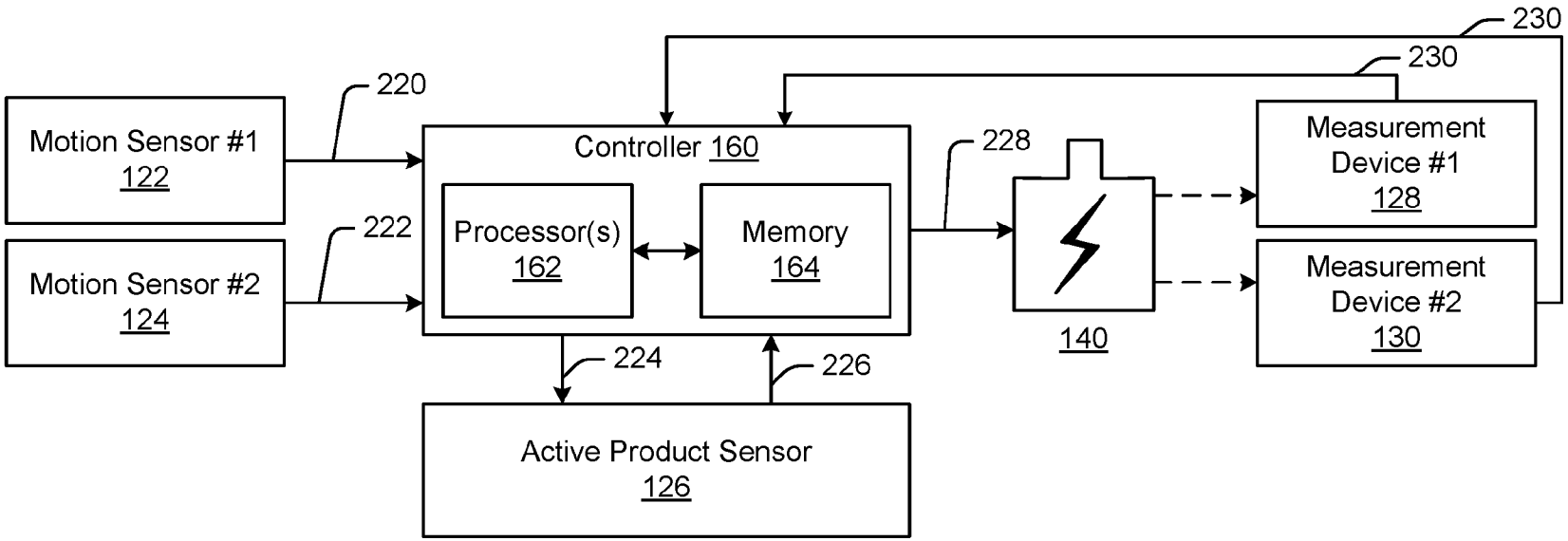
FIG. 4 schematically illustrates certain components of the dual roll dispenser of FIG. 1 in accordance with one or more example embodiments.

Referring now to FIGS. 3 and 4, a method of managing power consumption at a dispenser 200 is illustrated in FIG. 3, and a schematic diagram of the dual roll dispenser 100 is illustrated in FIG. 4. The method 200 will be discussed in conjunction with the schematic illustration of FIG. 4. Referring first to FIG. 3, at block 202 of method 200, the method 200 includes receiving, by the controller 160, a first trigger from at least one motion sensor, which in the embodiment illustrated in FIG. 2 may be either the first motion sensor 122 or the second motion sensor 124. Referring to FIG. 4, upon activation of the first motion sensor 122, the first motion sensor 122 may send the first trigger to the controller 160 at communication 220. Similarly, if the second motion sensor 124 is activated, the second motion sensor 124 may transmit the first trigger to the controller 160 at communication 222. In embodiments with a single motion sensor, the single motion sensor may send the first trigger. The controller 160 may store the time the first trigger is received, as well as the motion sensor that sent the first trigger, in memory 164. The first trigger may cause the controller 160 to wake from a power save mode, where the controller 160 draws minimal or no power from the energy source 140.

Upon receiving the first trigger, the controller 160 may initiate a predetermined time interval timer and a maximum operation period timer. The predetermined time interval may be, for example, 5 seconds or 10 seconds, or any other time period, during which the controller 160 may receive a second trigger, from either the first motion sensor 122 or the second motion sensor 124, indicating the stall 94 is still occupied. In embodiments with a single motion sensor, the single motion sensor may send the second trigger. If a second trigger is not received by the controller 160, the controller 160 may determine the stall 94 is no longer occupied and the time and any motion sensor data may be stored in memory 164. The controller 160 may then return to a sleep or low-power state. The maximum operation period may be, for example, 5 minutes or 6 minutes, or any other desired time period between consecutive triggers, after which the controller 160 will time out and return to a sleep or low-power state and depower the measurement device, thereby preventing excessive draining of the energy source 140. Upon receiving the second trigger, both the predetermined time interval timer and the maximum operation period timer are reset, and both of the respective timers may be restarted.

At block 204 of FIG. 3, the method 200 includes determining an active product being dispensed by the dual roll dispenser 100. Referring now to FIG. 4, the controller 160 may determine an active product being dispensed by communicating with the active product sensor 126 at communication 224. The controller 160 may receive input from the active product sensor 126 at communication 226 indicating which product is actively being dispensed from the dual roll dispenser 100. The active product sensor 126 may be operable to detect a position of the sliding door 112 (shown in FIG. 2), for example, in order to determine the active product. In some embodiments, the dual roll dispenser 100 may include multiple active product sensors, for example one active product sensor for each product in the dispenser, and the controller 160 may determine an active product based at least in part on a dispenser portion identifier received from an active product sensor associated with the active product. The dispenser portion identifier may be associated with product dispensed from a certain dispenser portion. In some embodiments, the active product is different from the inactive product. For example, the active product dispensed by the dispenser may be tissue paper, and the inactive product dispensed by the dispenser may be facial tissue.

At block 206 of the method 200 in FIG. 3, the method includes powering, in response to the first trigger, a measurement device configured to measure an amount of the active product dispensed by the dispenser. In FIG. 4, the controller 160 directs the energy source 140 at communication 228 to power either the first measurement device 128 or the second measurement device 130, based at least in part on the determined active product being dispensed. For example, if the product associated with the first measurement device 128 is the active product, the first measurement device 128 will be powered. As discussed herein, the measurement device may be a rotary encoder configured to contact the active product.

At block 208 of the method 200 in FIG. 3, the method includes receiving, from the measurement device, dispense event information associated with the measured amount of the active product dispensed by the dispenser during a dispense event. In FIG. 4, the powered measurement device of either the first or second measurement devices 128, 130, communicates dispense information associated with the measured amount of the active product dispensed by the dispenser during a dispense event to the controller 160, as indicated by directional arrows 230. As the controller 160 receives dispense event information from the measurement device, the controller 160 may wait to complete a quiet time interval, during which no additional data is received, in order to determine if the dispense event is complete. The quiet time interval may be, for example, 2 seconds, 5 seconds, or another time period, after which the controller 160 determines the dispense event is complete and stores the dispense event information on memory 164. In some embodiments, dispense event information includes a length of dispensing time, an active product identifier, a dispensing direction of the active product, a speed of dispensing, or a combination thereof. The length of dispensing time may be determined based at least in part on a quiet time interval following receiving the dispense event information, in that the dispense event occurring prior to the quiet time interval constitutes the length of dispensing time. The length of dispensing time may also be calculated as the length of time data is received from the powered measurement device. The dispense event information also may include the length of tissue paper dispensed per usage.

At block 210 of the method 200 in FIG. 3, the method includes storing the dispense event information received from the measurement device associated with the active product. In FIG. 4, the controller 160 may store the dispense event information in on-board memory 164. The controller 160 may also store chronological information associated with the first trigger, or chronological information associated with the dispense event information. Such chronological information may include dates, times, sequences of dispense events, and other chronological information. As discussed above, in some embodiments, the controller 160 may wait for a second trigger during a predetermined time interval after the first trigger is received by the controller 160 before storing the dispense event information. The predetermined time interval may be, for example, 10 seconds, and may act as a buffer to determine if the stall 94 is still occupied. In this way, dispense event information may be associated with a single usage event.

The controller 160 may time out after a maximum operation period, where the maximum operation period is measured between consecutive triggers received by the controller 160 to prevent excess power consumption by the data collection system 120. As discussed above, the maximum operation period may be about 5 minutes, or 10 minutes, or another time. After timing out, the controller 160 may depower the measurement device associated with the active product and enter a sleep or low-power state. In one example, such a situation may occur if a false trigger woke the controller 160 and no user is present.

In some embodiments, the data collection system 120 may further include wireless communication functionality, for example, a radio or other wireless hardware configured to provide wireless communication. The wireless hardware may implement, for example, 3G/4G/5G cellular communication, WiFi, WiFi Direct, BLUETOOTH™, BLUETOOTH LE™ or other wireless communication methods. Using the wireless communication functionality, the data collection system may wirelessly communicate stored dispense event information to a remote server. The data collection system 120 may also communicate stored dispense event information via a wired or hardware connection.

The dual roll dispenser 100 shown in FIG. 1 is illustrated by way of example only. Other system embodiments can include fewer or greater numbers of elements and/or components, which may perform similar or different functions and/or operations than described above. One will recognize the applicability of the disclosure to various other system embodiments.

Using the embodiments described herein, maintenance time and costs may be reduced as the dispensers described herein manage the power consumption of data collection systems such that the data collection systems are powered at specific times, for example when a dispense event is imminent. Additionally, the data collected by the data collection systems of the dispensers described herein may be more accurate, as discrete user data may be collected.

The operations and methods described and shown above may be carried out or performed in any suitable order as desired in various implementations. Additionally, in certain implementations, at least a portion of the operations may be carried out in parallel. Furthermore, in certain implementations, less than or more than the operations described may be performed.

These computer-executable program instructions described herein with respect to the controller 160 may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

That which is claimed is:

1. A method of managing power consumption at a dispenser comprising a controller, the method comprising:

receiving, by the controller, a first trigger from at least one motion sensor, wherein the controller is in an awake state before the first trigger is received;

determining an active product being dispensed by the dispenser;

causing, in response to the first trigger, a measurement device to enter an awake state, wherein the measurement device is configured to measure an amount of the active product dispensed by the dispenser;

receiving, from the measurement device, dispense event information associated with the measured amount of the active product dispensed by the dispenser during a dispense event; and storing or transmitting the dispense event information.

2. The method of claim 1, wherein dispense event information includes a length of dispensing time, an active product identifier, a dispensing direction of the active product, a speed of dispensing, or a combination thereof.

3. The method of claim 2, wherein the length of dispensing time comprises a quiet time interval that occurs after the dispense event is complete.

4. The method of claim 1, further comprising waiting for a predetermined time interval after the first trigger is received by the controller before storing or transmitting the dispense event information.

5. The method of claim 1, wherein the dispenser comprises a first motion sensor and a second motion sensor, and the first trigger is received from either the first motion sensor or the second motion sensor.

6. The method of claim 5, further comprising waiting for a predetermined time interval after the first trigger is received by the controller before storing or transmitting the dispense event information.

7. The method of claim 6, further comprising:

receiving a second trigger from either the first motion sensor or the second motion sensor; and restarting the predetermined time interval.

8. The method of claim 5, wherein the dispenser comprises a first dispenser portion comprising the active product and a second dispenser portion comprising an inactive product;

the first motion sensor is positioned at a first side of the dispenser; and the second motion sensor is positioned at a second side of the dispenser.

9. The method of claim 8, wherein the active product is different from the inactive product.

10. The method of claim 1, further comprising:

timing out after a maximum operation period, wherein the maximum operation period is measured between consecutive triggers received by the controller; and depowering the measurement device after timing out.

11. The method of claim 1, further comprising storing or transmitting chronological information associated with the first trigger or the dispense event information.

12. The method of claim 1, wherein determining the active product being dispensed by the dispenser comprises receiving a dispenser portion identifier from an active product sensor associated with the active product.

13. The method of claim 1, further comprising:

receiving a second trigger from the at least one motion sensor;

causing the controller to enter the awake state responsive to the second trigger, wherein the second trigger is received before the first trigger, and wherein the measurement device remains in a power save mode after the second trigger is received.

14. The method of claim 1, wherein the at least one motion sensor is a passive infrared sensor.

15. The method of claim 1, wherein the measurement device is a rotary encoder configured to contact the active product.

16. The method of claim 1, wherein the dispense event information is stored, the method further comprising communicating the stored dispense event information to a remote server via wireless communication.

17. The method of claim 1, wherein the active product dispensed by the dispenser comprises tissue paper.

18. The method of claim 17, wherein the dispense event information comprises the length of tissue paper dispensed per usage.

19. A dispenser comprising:

at least one motion sensor;

an energy source;

one or more measurement devices; and a controller communicatively coupled to the at least one motion sensor, the energy source, and the one or more measurement devices, the controller comprising a memory having computer-executable instructions operable to, when executed by at least one processor, enable the at least one processor to implement a method comprising:

receiving a first trigger from the at least one motion sensor, wherein the controller is in an awake state before the first trigger is received;

determining an active product being dispensed by the dispenser;

causing, in response to the first trigger, one of the one or more measurement devices to enter an awake state, wherein the one of the one or more measurement devices is configured to measure an amount of the active product dispensed by the dispenser;

receiving, from the measurement device in the awake state, dispense event information associated with the measured amount of the active product dispensed by the dispenser during a dispense event; and storing or transmitting the dispense event information in the memory.

20. The dispenser of claim 19, wherein the dispenser comprises a first motion sensor and a second motion sensor, and the first trigger is received by the controller from either the first motion sensor or the second motion sensor.

21. The dispenser of claim 20, wherein the dispenser comprises a first dispenser portion comprising the active product and a second dispenser portion comprising an inactive product;

the first motion sensor is positioned at a first side of the dispenser; and the second motion sensor is positioned at a second side of the dispenser.

22. The dispenser of claim 21, wherein the active product is different from the inactive product.

23. The dispenser of claim 19, further comprising an active product sensor configured to determine the active product being dispensed by the dispenser.

24. The dispenser of claim 19, wherein the at least one motion sensor is a passive infrared sensor.

25. The dispenser of claim 19, wherein the one or more measurement devices is a rotary encoder configured to contact the active product.

26. The dispenser of claim 19, wherein the active product dispensed by the dispenser comprises tissue paper.

* * * * *